US006955556B2

(12) United States Patent
Wei

(10) Patent No.: US 6,955,556 B2
(45) Date of Patent: Oct. 18, 2005

(54) CONNECTOR FOR ELECTRONIC DEVICE

(75) Inventor: Chih-Sheng Wei, Taoyuan (TW)

(73) Assignee: BENQ Corporation, Taoyuan (TW)

( * ) Notice: Subject to any disclaimer, the term of this patent is extended or adjusted under 35 U.S.C. 154(b) by 0 days.

(21) Appl. No.: 10/730,408

(22) Filed: Dec. 8, 2003

(65) Prior Publication Data

US 2004/0137779 A1 Jul. 15, 2004

(30) Foreign Application Priority Data

Jan. 10, 2003 (TW) ..... 92200457 U

(51) Int. Cl.[7] ..... H01R 13/627
(52) U.S. Cl. ..... 439/358; 439/357
(58) Field of Search ..... 439/350, 357–358, 439/351–356

(56) References Cited

U.S. PATENT DOCUMENTS 3,473,693 A * 10/1969 Fritz ..... 220/314
3,783,320 A * 1/1974 Clement ..... 361/675
5,118,306 A * 6/1992 Bixler et al. ..... 439/405
5,178,556 A 1/1993 Chen ..... 439/357
5,454,726 A * 10/1995 Lee et al. ..... 439/65
5,588,864 A 12/1996 Lin ..... 439/357
5,741,150 A * 4/1998 Stinson et al. ..... 439/358
5,860,826 A * 1/1999 Chang ..... 439/358
5,971,790 A * 10/1999 Rohde ..... 439/357
6,099,339 A * 8/2000 Yanagida et al. ..... 439/358
6,149,451 A * 11/2000 Weber ..... 439/358
6,217,364 B1 * 4/2001 Miskin et al. ..... 439/358

* cited by examiner

*Primary Examiner*—Michael C. Zarroli
(74) *Attorney, Agent, or Firm*—Quintero Law Office

(57) ABSTRACT

A connector includes a first housing, a second housing, a screw, and a resilient lever. The first housing defines a through hole and the second housing has a threaded post. The screw passes through the through hole and fastens to the threaded post. The resilient lever includes a hook for sustaining a pulling force. The resilient lever is rotatably connected to the threaded post so that the pulling force is substantially aligned with the threaded post.

13 Claims, 3 Drawing Sheets

CONNECTOR FOR ELECTRONIC DEVICE

BACKGROUND OF THE INVENTION

1. Field of the Invention

The present invention relates to a connector. In particular, the present invention relates to a connector that can firmly fasten to an electronic device.

2. Description of the Prior Art

Currently, there are several connection methods for electronic connectors such as screws or hook mechanism. The hook mechanism is often too weak to engage firmly. Thus, the connector is easily detached from the electronic device when accidentally pulled or rotated. Moreover, resilient elements suffer from permanent deformation due to material fatigue over long-term use. Related patents include U.S. Pat. No. 5,588,864 and U.S. Pat. No. 5,178,556.

SUMMARY OF THE INVENTION

An object of the present invention is to provide a connector that solves the above-mentioned problem.

The connector of the present invention includes a first housing, a second housing, a screw, and a resilient lever. The first housing defines a through hole. The second housing has a threaded post. The screw passes through the through hole and fastens to the threaded post. The resilient lever includes a hook for sustaining a pulling force. The resilient lever is rotatably connected to the threaded post so that pulling force is substantially directed to the threaded post.

DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

Figure 1:
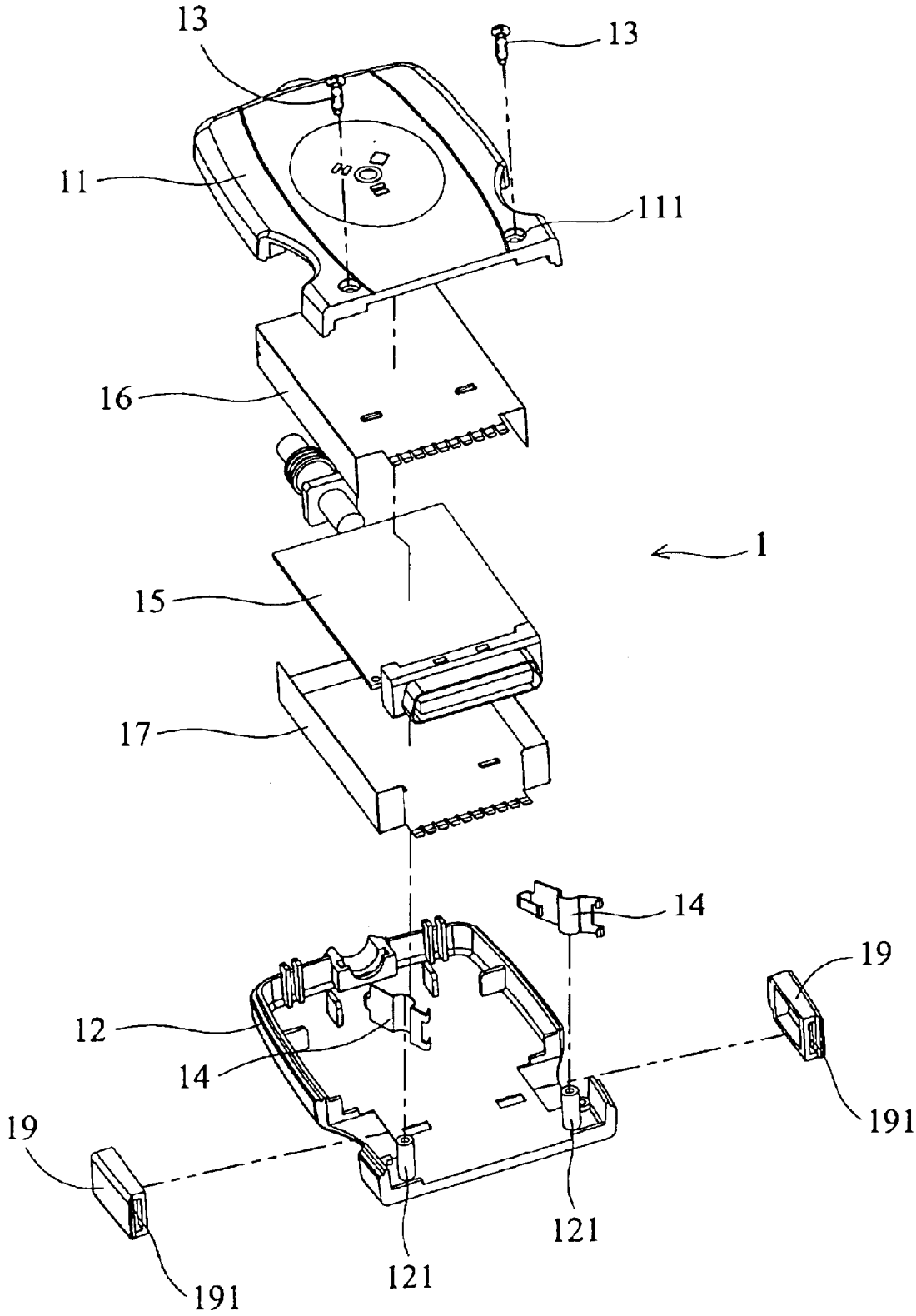
FIG. 1 is an exploded perspective diagram of a connector in accordance with the present invention.

FIG. 1 is an exploded perspective diagram of a connector of the present invention. The connector (1) includes a first housing (11), a second housing (12), screws (13), resilient levers (14), and a body (15) with a circuit board. The body (15) is housed between two metal brackets (16, 17). The metal brackets (16, 17) are used to prevent electromagnetic leakage. The first housing (11) defines a through hole (111) and the second housing (12) has a threaded post (121). The first housing (11) and the second housing (12) are fixed together by the screw (13) passing through the through hole (111) and fastening to the threaded post (121) to contain all parts of the connector (1). Two keys (19, 19) are disposed on either side of the connector (1). The keys (19, 19) contact the resilient levers (14), respectively.

Figure 2:
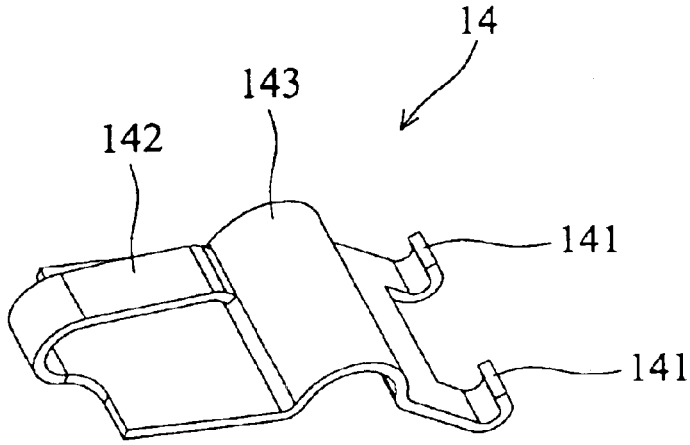
FIG. 2 is a perspective diagram of a resilient lever in accordance with the present invention.

Referring to FIG. 2, the resilient lever (14) includes a pair of hooks (141), a pressing portion (142), and a curved portion (143). The hook sustains a pulling force and connects to the engaging portions of an electronic device. The pressing portion (142) of the resilient lever (14) is inserted into the receiving portion of each key (19) through an access opening (191) and rotated till the hook (141) depart from the key (19). Then, each key (19) and the resilient lever (14) are disposed in the second housing (12). The curved portion (143) of the resilient lever (14) abuts the threaded post (121), and the pressing portion (142) contacts the body (15). The key (19) presses the pressing portion respectively (142) when the key (19) is pushed, and the curved portion (143) closely rotates around the threaded post (121).

Figure 3:
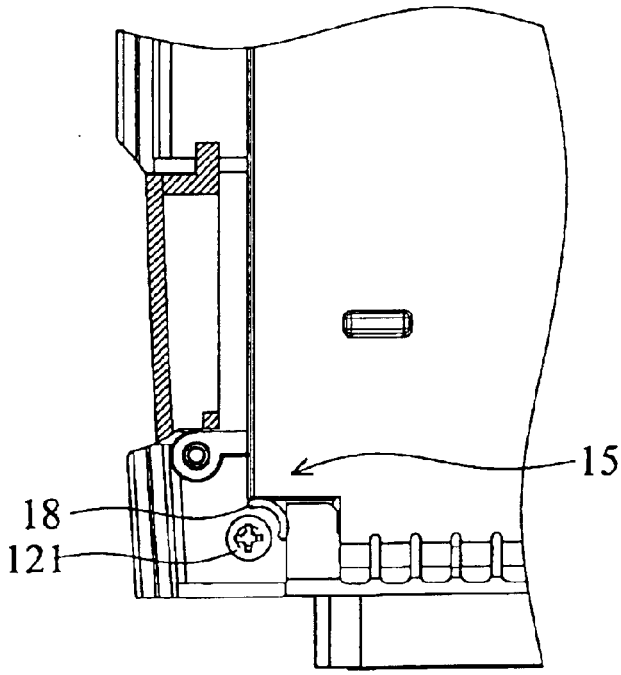
FIG. 3 is a local enlarge view of the present invention.

Referring to FIG. 3, a gap formed between the body (15) and the threaded post (121) accepts a constraining wall (18) near the body (15). The profile of the constraining wall (18) corresponds to the curved portion (143) of the resilient lever (14) and the threaded post (121), such that the gap between the constraining wall (18) and the threaded post (121) forms an arc.

Referring to FIGS. 1, 2, 3 and 4, the key (19) contacts the pressing portion (142). When assembling the resilient lever (14) and the second housing (12), the curved portion (143) is disposed in the gap between the constraining wall (18) and the threaded post (121). Thus, the curved portion (143) of resilient lever (14) is limited between the threaded post (121) and the constraining wall (18). The feature of the present invention is that the resilient lever (14) is rotatably connected to the threaded post (121) so that the pulling force sustained by the hook (141) is substantially directed to the threaded post (121).

Figure 4:
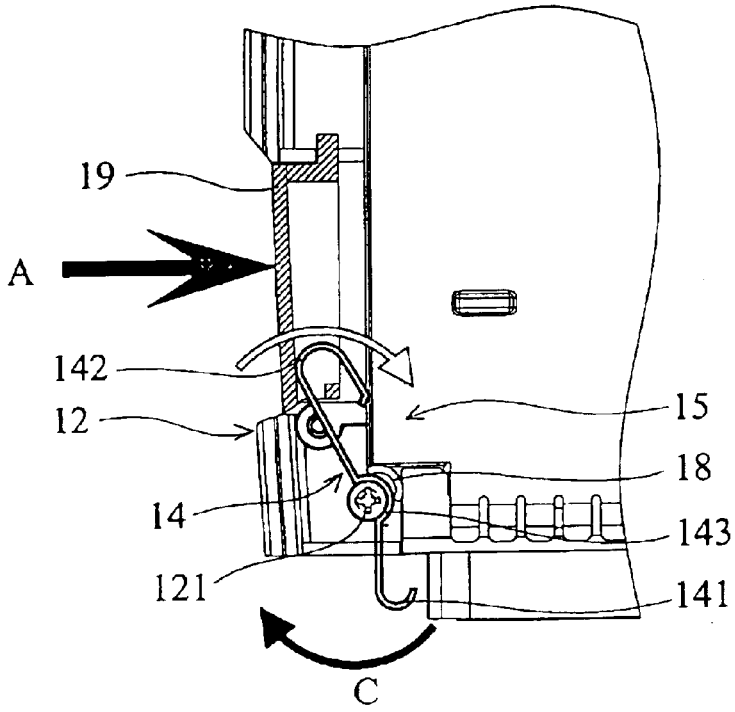
FIG. 4 is a local schematic view of the present invention.
Figure 5:
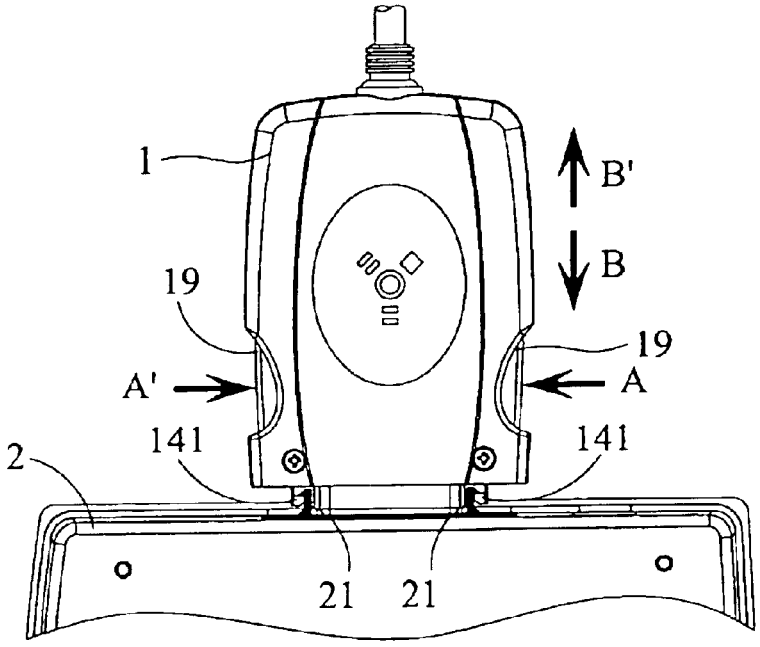
FIG. 5 is a schematic diagram of the present invention.

Referring to FIGS. 4 and 5, when detaching the connector 1 from an electronic device 2, the user presses each key (19) in directions A, A'. As shown in FIG. 4, the key (19) pushes the curved portion (142) of the resilient lever (14) so that the resilient lever (14) is rotated about the threaded post (121) in direction C. Then, the hook (141) of the resilient lever (14) is disengaged from the engaging portions (21) of the electronic device (2) so that the user can withdraw the connector (1) in direction B'. When the resilient lever (14) is rotated, a part of pressing portion (142) not contacting the key (19) pushes against the body (15) to be deformed. When the user releases the key (19), the deformed pressing portion (142) of the resilient lever (14) is restored to the original position via the restoring force.

When connecting the connector (1) to the electronic device (2), the connector (1) is pushed toward the electronic device in direction B. The hook (141) of the resilient lever (14) has arc-shaped surfaces, allowing the engaging portion (21) of the electronic device (2) to engage with the resilient lever (14), without requiring pressing of the keys (19).

Referring to FIGS. 4 and 5, the hook (141) of the resilient lever (14) sustains the pulling force from the engaging portion (21). The resilient lever (14) is rotatably connected to the threaded post (121) so that the pulling force is substantially directed to the threaded post (121). Unless the connector (1) is withdrawn by pressing the key (19), accidental pulling or rotation of the connector (1) does not separate the connector (1) from the electronic device (2).

Thus, the connector of the present invention has the advantages of strong engaging force to prevent detachment by accidental pulling or rotation, simpler assembly, improved resilient lever reliability, and the rotating range of the resilient lever thereon is reduced so that access to the body is increased and volume of the connector is reduced.

Finally, while the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A connector, comprising:

a first housing defining a through hole;

a second housing having a threaded post;

a screw passing through the through hole and fastening to the threaded post;

a resilient lever having a pressing portion, a curved portion and a hook for sustaining a pulling force, rotatably connected to the threaded post, wherein the pulling force is substantially directed to the threaded post; and a key contacting the resilient lever, the resilient lever rotated by the threaded post when the key is pushed, wherein the key presses the pressing portion when pushed, and the curved portion rotates closely around the threaded post.

2. The connector as claimed in claim 1, further comprising a body and a constraining wall, wherein the body is contained in the first and the second housings, a gap formed between the body and the threaded post receives the constraining wall, and the curved portion of the resilient lever is limited between the threaded post and the constraining wall.

3. The connector as claimed in claim 2, wherein a profile of the constraining wall corresponds to the curved portion of the resilient lever.

4. A connector, comprising:

a first housing defining a through hole;

a second housing having a threaded post;

a screw passing through the through hole and fastening to the threaded post;

a resilient lever having a hook for sustaining a pulling force, rotatably connected to the threaded post so that the pulling force is substantially directed to the threaded post; and a key detachably connecting to the resilient lever, wherein the resilient lever is rotated around the threaded post when the key is pushed.

5. A connector, comprising:

a first housing defining a through hole;

a second housing having a threaded post and a side;

a body contained in the first and second housings;

a screw passing through the through hole and fastening to the threaded post; and a resilient lever comprising a pressing portion, a curved portion and a hook, wherein the curved portion is rotatably connected to the threaded post, the pressing portion is connected to an end of the curved portion and abuts the body, the hook is connected to the other end of the curved portion, the curved portion is curving away from the side, when an external force is employed on the pressing portion, the pressing portion deforms to impel the curved portion to rotate around the threaded post.

6. The connector as claimed in claim 5, wherein the resilient lever further comprises a connection portion connecting the pressing portion and the curved portion, wherein the pressing portion urges against the body when the connection portion is pushed, and the curved portion rotates closely around the threaded post.

7. The connector as claimed in claim 4, wherein the resilient lever further comprises a pressing position and a curved portion, the key presses the pressing portion when pushed, and the curved portion rotates closely around the threaded post.

8. The connector as claimed in claim 7, further comprising a body and a constraining wall, wherein the body is contained in the first and the second housings, a gap formed between the body and the threaded post receives the constraining wall, and the curved portion of the resilient lever is limited between the threaded post and the constraining wall.

9. The connector as claimed in claim 8, wherein a profile of the constraining wall corresponds to the curved portion of the resilient lever.

10. The connector as claimed in claim 5, further comprising a key contacting the resilient lever, the resilient lever rotated by the threaded post when the key is pushed.

11. The connector as claimed in claim 10, wherein the key presses the pressing portion when pushed, and the curved portion rotates closely around the threaded post.

12. The connector as claimed in claim 11, further comprising a constraining wall, wherein a gap formed between the body and the threaded post receives the constraining wall, and the curved portion of the resilient lever is limited between the threaded post and the constraining wall.

13. The connector as claimed in claim 12, wherein a profile of the constraining wall corresponds to the curved portion of the resilient lever.

* * * * *